US010493469B2

(12) United States Patent
Hornek et al.

(10) Patent No.: US 10,493,469 B2
(45) Date of Patent: Dec. 3, 2019

(54) CENTRIFUGE ROTOR WITH LID LOCKING MECHANISM

(71) Applicant: ANDREAS HETTICH GMBH & CO. KG, Tuttlingen (DE)

(72) Inventors: Matthias Hornek, Tuttlingen (DE); Rainer Prilla, Messstetten (DE); Andreas Hoelderle, Doeggingen (DE); Klaus-Guenter Eberle, Tuttlingen (DE)

(73) Assignee: ANDREAS HETTICH GMBH & CO. KG., Tuttlingen (DE)

( * ) Notice: Subject to any disclaimer, the term of this patent is extended or adjusted under 35 U.S.C. 154(b) by 612 days.

(21) Appl. No.: 15/241,004

(22) Filed: Aug. 18, 2016

(65) Prior Publication Data

US 2017/0050194 A1 Feb. 23, 2017

(30) Foreign Application Priority Data

Aug. 20, 2015 (DE) ..... 10 2015 113 854

(51) Int. Cl.
*B04B 9/08* (2006.01)
*B04B 7/02* (2006.01)
(Continued)

(52) U.S. Cl.
CPC ..... *B04B 7/06* (2013.01); *B04B 7/00* (2013.01); *B04B 9/00* (2013.01); *B04B 2007/025* (2013.01); *B04B 2009/085* (2013.01)

(58) Field of Classification Search
CPC ..... B04B 9/08; B04B 2009/085; B04B 7/06; B04B 7/00; B04B 9/00; B04B 7/08;
(Continued)

(56) References Cited

U.S. PATENT DOCUMENTS 2,329,499 A * 9/1943 Weaver ..... D01D 7/02 57/77
2,827,229 A * 3/1958 Blum ..... B04B 5/0414 464/91
(Continued)

FOREIGN PATENT DOCUMENTS

CN 201692882 U 1/2011
CN 203856304 U 10/2014
(Continued)

OTHER PUBLICATIONS

The State Intellectual Property Office of China, First Office Action, dated Sep. 17, 2018, Application No. 201610803937.1.
(Continued)

*Primary Examiner* — Charles Cooley
(74) *Attorney, Agent, or Firm* — Woodling, Krost and Rust

(57) ABSTRACT

A rotor 10 of a centrifuge 100 having a rotor axis R, a receiving space 18 for samples to be centrifuged, a lid 40 which limits the receiving space 18 at the top, which is concentrically mounted relative to the rotor and which has, on its side remote from the receiving space 18, a handle 44 for carrying the rotor and the lid 40, and a locking mechanism of lid 40 and rotor, which mechanism is mounted in a support 52, 54 in the lid 40, said locking mechanism 50, 34*b* comprising a locking element 50 adapted to be movable between a locking position and an unlocking position and which has an actuating member 56 and a latching element 58, with the actuating member 56 and the latching element 58 being axially spaced from each other relative to the rotor axis R. The invention is characterized in that the locking element 50 is formed by a tilt lever which has the actuating member 56 mounted on its upper end and the latching
(Continued)

element 58 mounted on its lower end, with its pivot axis being aligned perpendicular to the rotor axis R.

2 Claims, 5 Drawing Sheets

(51) Int. Cl.
*B04B 7/06* (2006.01)
*B04B 7/00* (2006.01)
*B04B 9/00* (2006.01)

(58) Field of Classification Search
CPC ... B04B 5/0414; B04B 7/02; B04B 2007/025; F16D 1/108
USPC ..... 494/16, 12
See application file for complete search history.

(56) References Cited

U.S. PATENT DOCUMENTS 2,865,662 A * 12/1958 Nurmse ..... A01K 89/0111 242/318
3,819,111 A * 6/1974 Romanauskas ..... B04B 5/0414 494/16
3,961,745 A * 6/1976 Wright ..... B04B 7/06 494/9
4,193,538 A * 3/1980 Schwarz ..... B04B 5/0414 494/16
4,412,830 A * 11/1983 Strain ..... B04B 7/02 494/12
4,435,169 A * 3/1984 Romanauskas ..... B04B 5/0421 494/20
4,753,631 A * 6/1988 Romanauskas ..... B04B 5/0414 494/12
4,822,331 A 4/1989 Taylor
5,342,282 A * 8/1994 Letourneur ..... B04B 9/12 384/480
5,344,380 A * 9/1994 Chern ..... B04B 5/0414 494/12
5,411,465 A * 5/1995 Glen ..... B04B 5/0414 494/16
5,681,257 A * 10/1997 Letourneur ..... B04B 9/08 403/325
5,897,482 A * 4/1999 Lowe ..... B04B 5/0414 411/424
6,056,684 A * 5/2000 Linder ..... B04B 7/02 494/12
6,063,018 A * 5/2000 Letourneur ..... B04B 9/08 403/327
6,149,570 A * 11/2000 Lowe ..... B04B 5/0414 494/12
6,665,924 B2 * 12/2003 Schutz ..... B04B 5/0414 29/525.11
6,764,438 B2 * 7/2004 Potter ..... B04B 5/0414 494/12
6,776,751 B2 * 8/2004 Potter ..... B04B 9/08 494/12
6,802,803 B2 * 10/2004 Potter ..... B04B 5/0414 494/12
6,981,304 B2 * 1/2006 Potter ..... B04B 5/0414 29/428
7,011,618 B2 * 3/2006 Potter ..... B04B 9/08 494/12
7,081,081 B2 * 7/2006 Schutz ..... B04B 9/08 494/12
7,137,198 B2 * 11/2006 Potter ..... B04B 5/0414 29/889
7,311,652 B2 * 12/2007 Henne ..... B04B 5/0414 494/12
7,419,464 B2 * 9/2008 Matusima ..... B04B 9/08 403/322.2
7,464,450 B2 * 12/2008 Potter ..... B04B 9/08 29/428
7,837,607 B2 * 11/2010 Woodman ..... B04B 5/0421 494/12
8,678,987 B2 * 3/2014 Henne ..... B04B 9/08 494/12
9,718,067 B2 * 8/2017 Ballhause ..... B04B 9/00
9,782,783 B2 * 10/2017 Bittner ..... B04B 9/08
10,300,499 B2 * 5/2019 Hornek ..... B04B 9/08
2003/0144124 A1 * 7/2003 Schutz ..... B04B 5/0414 494/12
2003/0196310 A1 * 10/2003 Potter ..... B04B 5/0414 29/428
2003/0199380 A1 * 10/2003 Potter ..... B04B 9/08 494/12
2003/0199381 A1 * 10/2003 Potter ..... B04B 5/0414 494/12
2004/0018928 A1 * 1/2004 Schutz ..... B04B 9/08 494/12
2004/0220037 A1 * 11/2004 Potter ..... B04B 5/0414 494/12
2004/0224831 A1 * 11/2004 Potter ..... B04B 5/0414 494/12
2004/0229742 A1 * 11/2004 Potter ..... B04B 9/08 494/12
2005/0221971 A1 * 10/2005 Potter ..... B04B 9/08 494/37
2006/0058169 A1 * 3/2006 Matusima ..... B04B 9/08 494/84
2006/0240963 A1 * 10/2006 Henne ..... B04B 5/0414 494/16
2008/0146429 A1 * 6/2008 Woodman ..... B04B 5/0421 494/12
2011/0212822 A1 * 9/2011 Henne ..... B04B 9/08 494/84
2013/0188894 A1 * 7/2013 Peters ..... B04B 9/08 384/91
2014/0329658 A1 * 11/2014 Le Guyader ..... B04B 9/08 494/82
2016/0158769 A1 * 6/2016 Hornek ..... B04B 9/08 494/83
2017/0050195 A1 * 2/2017 Hornek ..... B04B 5/0414
2017/0252754 A1 * 9/2017 Hoelderle ..... B04B 9/08
2018/0318847 A1 * 11/2018 Luersmann ..... B04B 1/08

FOREIGN PATENT DOCUMENTS

CN 204093589 U 1/2015
DE 19930593 A1 * 4/2000 ..... B04B 9/08
DE 102005014218 3/2008
JP 2006272330 A * 10/2006 ..... B04B 5/0414
WO 8304379 A1 12/1983
WO WO-8304379 A1 * 12/1983 ..... B04B 5/0414
WO 2015007620 U 1/2015
WO WO-2019121214 A1 * 6/2019 ..... B04B 5/04
WO WO-2019121581 A1 * 6/2019 ..... B04B 5/0414

OTHER PUBLICATIONS

German Patent and Trademark Office, Search Report, dated Apr. 18, 2016,pp. 1-8, German Application No. 102015113854.9.

* cited by examiner

CENTRIFUGE ROTOR WITH LID LOCKING MECHANISM

This patent application claims priority to German patent application no. DE 10 2015 113 854.9, filed Aug. 20, 2015. German patent application no. DE 10 2015 113 854.9, filed Aug. 20, 2015, is incorporated herein by reference hereto in its entirety.

The invention relates to a rotor.

BACKGROUND OF THE INVENTION

A multitude of centrifuge rotors are known from the prior art which each have a receiving chamber that can be sealed with a lid. This protects the centrifuge and the environment from contamination in the event of a vessel rupture inside the receiving chamber of the rotor.

DE 10 2005 014 218 B4 discloses a mounting device for the lid of a centrifuge rotor. The mounting device comprises a latching element which cooperates with a rotor pin and is provided in a handle for the lid, with the latching element partly protruding from the handle and being supported such that the centrifugal force acting on the latching element will urge it into a locking position.

The above mentioned mounting device allows the lid to be securely locked on the rotor and to be left in its locked state in the event of uncontrolled leakage of sample material in operation. The handle provided on the lid can be used for carrying the rotor when the latter needs to be cleaned, and/or decontaminated, if necessary.

However, this locking mechanism takes up a lot of space as the actual locking action is achieved by bringing the latching element into a latching position where it will cooperate with the rotor pin in the handle of the lid, i.e. locking is accomplished above the lid. To ensure reliable locking, an adequately dimensioned rotor pin has to move through the plane of the lid and then engage the handle. If the axial extension of the rotor pin is too short, reliable locking cannot be achieved. If the radial expansion of the rotor pin is too small, the required stability cannot be ensured. Consequently, this type of locking mechanism is ill-suited for fixed angle rotors in which relatively large sample vessels are used, since the rotor pin takes up a lot of space in the receiving chamber, thus making insertion and removal of sample containers difficult.

Furthermore, the asymmetrical design and the specific location of the latching element will invariably cause imbalances in operation.

U.S. Pat. No. 4,822,331 A discloses a generic centrifuge in which the rotor is securely screwed onto the drive shaft for axially securing the rotor thereon. For this purpose, a tool needs to be passed through the lid and the drive shaft in order to turn a screw to either detach the rotor from the drive shaft or to secure the rotor to the drive shaft. Moreover, the rotor can be connected to a lid by means of a quick-release fastener. Operating an actuating member in the form of a pushbutton provided in the lid will detach the lid from the rotor by moving an axially offset latching element from a locking position thereof. Placing the lid onto the rotor will activate the quick-release fastener by displacing the latching element from an unlocking position into a locking position thereof, thus firmly connecting the lid to the rotor.

SUMMARY OF THE INVENTION

It is the object of the present invention to create a rotor which avoids the above mentioned shortcomings, whose locking mechanism takes up little space in the receiving chamber of the rotor and which reduces the risk of imbalances in operation.

The invention is based on the finding that choosing an axial design and arrangement for the locking element in the lid will save space in the receiving chamber of the rotor since no measures will be required in the rotor for bridging the axial offset of centric fixing means and lid. Moreover, such axial design and arrangement will make it easier to prevent imbalances. This can be implemented easily by means of a tilt lever.

In accordance with the invention, the rotor of a centrifuge comprises a rotor shaft, a receiving space for samples to be centrifuged, and a lid. The lid constitutes the upper boundary of the receiving chamber and is concentrically mounted relative to the rotor. Provided on the side of the lid facing away from the receiving space is a handle for carrying the rotor and the lid. Furthermore, a mechanism for locking the lid onto the rotor is provided which is mounted in a support in the lid. This locking mechanism comprises a locking element which can be moved between locking and unlocking positions and which is in the form of a quick-release fastener. No additional tool is required for the quick-release fastener. The locking element has an actuating member and a latching element which are axially spaced from each other with respect to the rotor shaft. This allows the position of the actuating member to be chosen regardless of the arrangement and the design of the rotor lid. For example, the actuating member can be disposed at a position above the rotor lid which can easily be accessed by the operator. This facilitates the operation of the locking mechanism and, at the same time, allows more flexibility regarding the lid design, thus providing more space for the receiving chamber.

According to the invention, the locking element is formed by a tilt lever which has the actuating member mounted on its upper end and the latching element on its lower end. The pivot axis extends in perpendicular to the rotor shaft. The dimensions of the one or plural tilt lever(s), their support and the position of the pivot axis can easily be chosen so as to achieve a locking action which, on the one hand, is sufficiently stable to allow secure transport of the rotor by means of the handle of the locked lid, and which, on the other hand, can be unlocked fast by the operator after transport. As a result, the lid will be locked onto the rotor in a safe and at the same time flexible manner.

In an advantageous embodiment of the invention, in the locking position, the latching element will engage a recess in the rotor. The position of the recess can easily be adapted to the structural features of the rotor and be chosen such that sufficiently stable locking can be achieved for transporting the rotor with the lid in place thereon. This results in more efficient use of the rotor and increased safety.

It is expedient for the locking mechanism to include a plurality of locking elements, more specifically also a plurality of actuating members, which are of identical design and are arranged at the same level relative to the rotor shaft and symmetrically to one another. This results in a more stable locking action which also has a beneficial effect on the rotors safety in operation.

Preferably, the pivot axis subdivides the locking element into the actuating member and the latching element. As a result, the locking elements are easy to produce and to install. This also reduces the cost of the rotor.

In practice, it has proven advantageous for the latching element and the actuating member to be of the same length.

The tilt lever will pivot by the same amount on both sides of the pivot axis. Consequently, a compact design is possible for the locking mechanism.

In another advantageous embodiment, a pin is coaxially mounted in the receiving space of the rotor, which pin has at least one recess for engagement with the one or plural latching element(s). Integrally forming the recess in the pin results in a shorter distance between the recess and the actuating member, and also allows the tilt levers to be made shorter. This clearly improves the stability of the locking system and facilitates its operation.

To further simplify the locking system, the recess provided in the pin can be formed by an annular groove. As a result, a latching element can engage the recess at any point in the plane in which the locking is performed. Consequently, when placing the lid onto the rotor, there is no need to align the locking device and/or the lid at a certain angle horizontally so that the latching element can engage the respective associated recess. This results in faster and more intuitive locking.

In one aspect of the invention, the pin engages the handle at least partially via a recess in the lid. This shortens the distance between the annular groove and the actuating member even more, thus making for an even more stable locking action.

It is considered advantageous for the pin to be of a conical design and to taper towards its free end. Firstly, it will take up less space in the handle, and the handle can be of a more compact design. Secondly, the conical free end also makes it easier to centre the lid when the latter is placed onto the rotor. This considerably improves handling of the rotor.

In an alternative embodiment, the pin is arranged on a coaxial shoulder on which a seal surrounding the pin is mounted. In the locked state, the lid rests on the seal, and the seal seals the receiving space of the rotor with respect to the pin and the recess in the lid. As a result, provided a seal is in place between the lid and the rotor head in the mutually associated contact area, the receiving space can be sealed well, more specifically, can be made aerosol-tight. The rotor can thus also be used for centrifuging samples which are potentially harmful to the operator or the environment, as even in case of a vessel rupture, no substances will leak from the receiving space and the rotor can be removed from the centrifuge with the lid locked on it. This considerably expands the range of rotor applications.

It is advantageous for the tilt lever to be spring-loaded in the direction of the locking position. This ensures safe automatic locking of the lid as it is placed onto the rotor, thus facilitating handling of the rotor.

In an advantageous embodiment of the invention, the handle is operatively connected to a blocking element which can be activated and which, when activated, will fix the locking element of the lid and the rotor in its locking position. The handle thus ensures that the locking mechanism will remain activated during transport of the rotor. This also prevents the locking mechanism from being released unintentionally during transport of the rotor, and thus the rotor from falling down—which considerably increases the safety of the rotor.

It is considered very advantageous for the support of the locking mechanism to be incorporated in a bearing body, more specifically in the form of a cylinder, which is arranged on top of the lid concentrically, as well as firmly connected, thereto. This further increases the stability of the locking mechanism.

It is expedient for the handle to be concentrically arranged and movably mounted relative to the bearing body. As a result, the handle can be assigned an additional function which it fulfils when moved relative to the bearing body. For example, the handle can be connected to a further element in such a way that moving the handle in one direction will activate this element, and moving the handle in the respective opposite direction will deactivate this element.

Preferably, the handle is integrally formed with the blocking element that can be activated, and is thus adapted to be moved together with the blocking element relative to the bearing body between a first position which will block the locking element in the locking position, and a second position which will release the locking element. It should be noted here that moving the locking element from the locking position into the releasing position will only be possible in the second position.

In one embodiment of the invention, it has proven advantageous to provide for the handle to be moved from the first position into the second position and vice versa on the bearing body, along the rotor shaft. Since the handle is also moved along the axis of rotation for placing the rotor into the centrifuge and for removing the rotor from the centrifuge, displacing the handle for activating/deactivating the blocking element and displacing the handle for removal/insertion are movements that are performed coaxially. This saves the operator an additional movement, thus facilitating handling of the rotor.

It is expedient if moving the handle with the blocking element away from the lid corresponds to a movement into a first position, and moving the handle with the blocking element toward the lid corresponds to a movement into a second position. Consequently, provided the locking element was not previously moved into the releasing position, lifting the handle will activate the blocking element, thus causing the rotor to be lifted along with the lid. Owing to the force of gravity acting on the rotor, the handle with the blocking element will remain in the first position, which is remote from the lid, during transport, in which position the locking element is blocked, thus preventing the handle from being released unintentionally. This arrangement thus reliably blocks the locking mechanism and considerably increases the safety of the rotor in transport.

In an advantageous further development of the invention, the handle is spring-loaded in the direction of the lid. Consequently, the handle with the blocking element will automatically move into the second position when the rotor is inserted into a centrifuge or placed on a surface, the operator releases the handle and thus there is no force acting on the handle in a direction away from the lid anymore. The locking element can then be moved into an unlocking position. This automatic movement of the handle saves the operator another movement, which in turn considerably facilitates handling of the rotor.

In another aspect of the invention, a locking device is provided for fixing the rotor in place with respect to the drive shaft of the centrifuge, wherein an activating element is provided in the lid for activating the locking device, which activating element can be accessed when the lid is in place on the rotor. The locking device can thus be activated and deactivated without the lid having to be removed from the rotor. This is of particular advantage, for example, when a vessel has ruptured inside the rotor and contamination of the environment has to be prevented. The rotor can then be disconnected from the drive shaft and be removed from the centrifuge with the lid in place. As a result, operation of the rotor is safer.

In accordance with the invention, a centrifuge is furthermore provided which includes a drive and a drive shaft, with the seat of a support for a rotor abutting on the free end of the drive shaft.

Additional advantages, features and possible applications of the present invention can be gathered from the description which follows, in which reference is made to the embodiments illustrated in the drawings.

Throughout the description, claims and drawings, those terms and associated reference signs are used as are listed in the List of Reference Signs which follows below.

DESCRIPTION OF THE INVENTION

Figure 1:
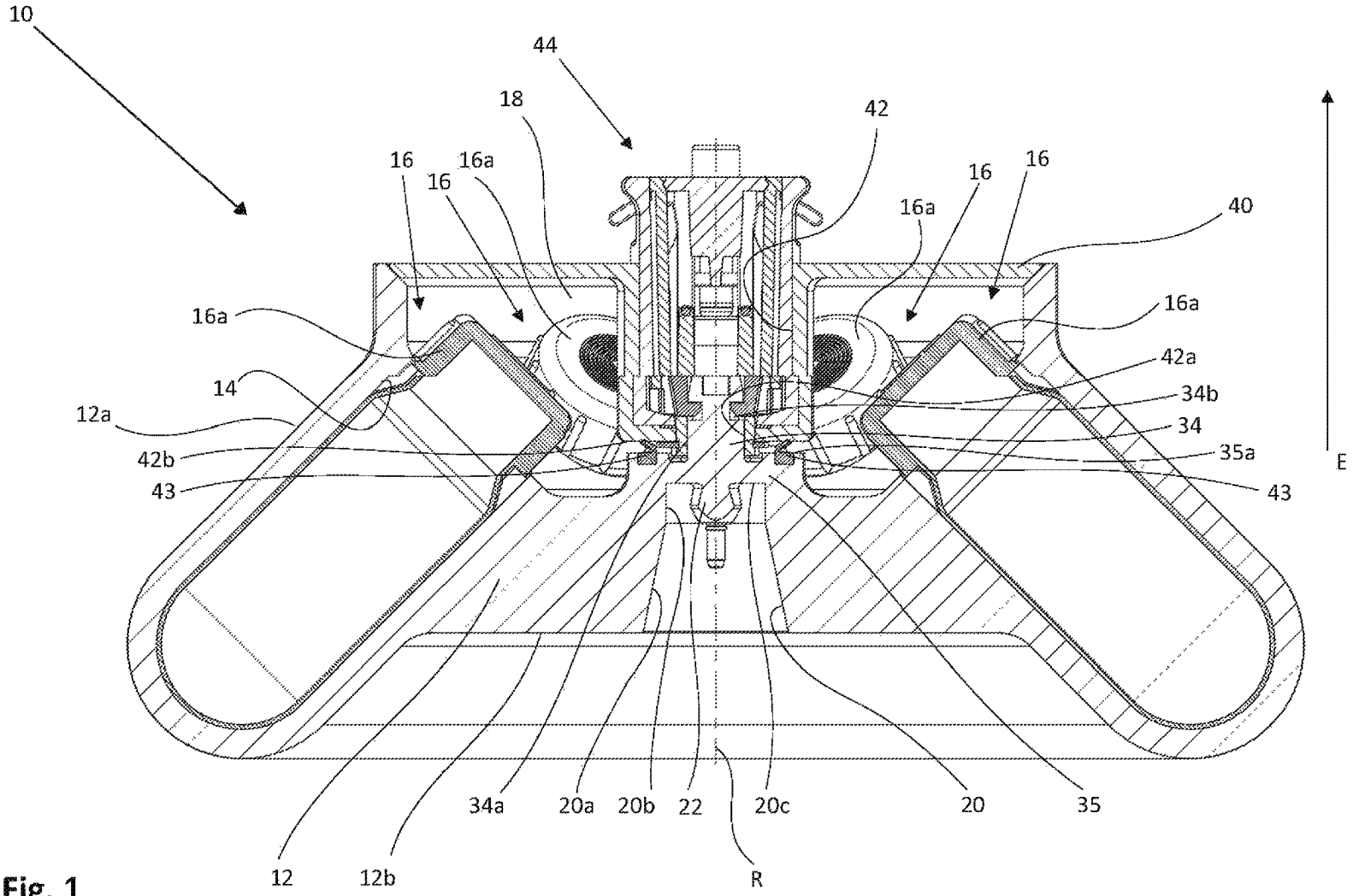
FIG. 1 is a lateral sectional view of the rotor according to the invention with the lid in place, in which the locking of the lid has been activated.

FIG. 1 is a lateral sectional view of a rotor 10 according to the invention with the lid 40 in place and activated locking of the lid 40.

The rotor 10 has the basic shape of a truncated cone which tapers toward the top. Provided in a rotor head 12 in a conventional manner and uniformly spaced from each other are receiving units 14 for sample containers 16. The longitudinal extension of the receiving units 14 is parallel to the lateral surface 12*a* of the rotor head 12. FIG. 1 shows four sample containers 16 inserted in the receiving units 14. Sealing caps 16*a* of the sample containers 16 protrude from the respective receiving units 14 into a receiving chamber 18 of the rotor 10.

Mounted concentrically in the bottom 12*b* of the rotor head 12 is a rotor seat 20 which is associated with the support 106 of the centrifuge 100. The rotor seat 20 has a frusto-conical first portion 20*a* which tapers in a removal direction E and which is joined by a cylindrical second portion 20*b* in an axial direction. The upper boundary of the rotor seat 20 is a boundary surface 20*c* which is perpendicular to the rotor axis R. Concentrically mounted on this boundary surface 20*c* is a locking ball 22 which faces the support 106 of the centrifuge 100 and extends away from the boundary surface 20*c* along the rotor axis R. The function of this locking ball 22 will be described in more detail with reference to FIGS. 3, 3*a* and 3*b*.

Above the locking ball 22, a shoulder 35 is formed in the receiving chamber 18 which is concentric to the rotor axis R. Likewise concentrically formed on said shoulder 35 is a rotor pin 34 whose external contour 34*a* tapers towards its free end. The rotor pin 34 is shown in more detail in FIG. 3 and in particular in the detail illustrated in FIG. 3*a*.

Placed on the rotor 10 is a lid 40 which seals the receiving chamber 18 from the outside in an aerosol-tight manner. Mounted concentrically relative to the lid 40 is a handle 44 which can be used to place the lid 40 on the rotor 10 and to remove the lid 40 from the rotor 10. The handle 44 is partially inserted in a blind hole shaped cylindrical recess 42 of the lid 40 and firmly connected to the lid 40 in a conventional manner. The recess 42 has an aperture 42*a* which is concentric to the rotor axis R and provided in the cylindrical bottom of the recess, and through which the free end of the rotor pin 34 engages the handle The axial extension of the recess 42 is dimensioned such that—in the state of the lid 40 in place on the rotor 10—the front face 42*b* of the recess 42 which faces the rotor seat 20 will extend right up to a front face 35*a* of the shoulder 35. A seal 43 provided in the front face 35*a* of the shoulder 35 seals the lid 40 from the shoulder 35 so as to prevent leakage of sample material from the receiving chamber 18 into the handle 44 and thus into the environment in the event of a vessel rupture or the like.

Figure 2A:
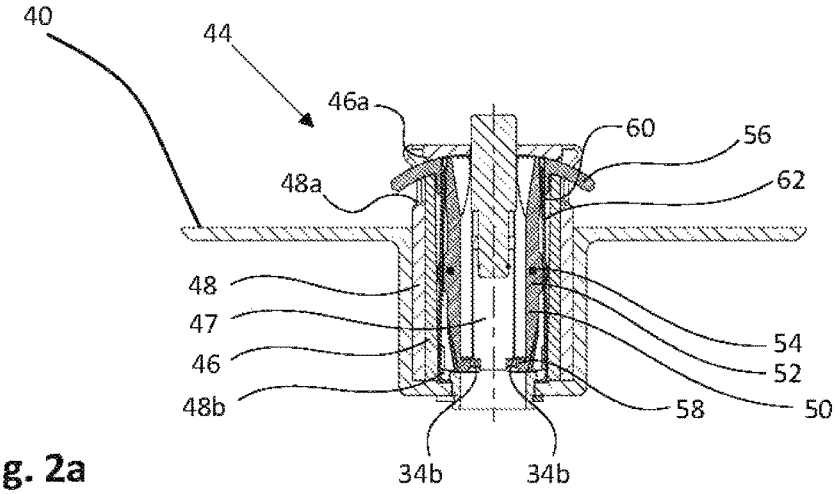
FIG. 2*a* is a lateral sectional view of the lid of FIG. 1, in which locking has been activated and blocking deactivated.
Figure 2B:
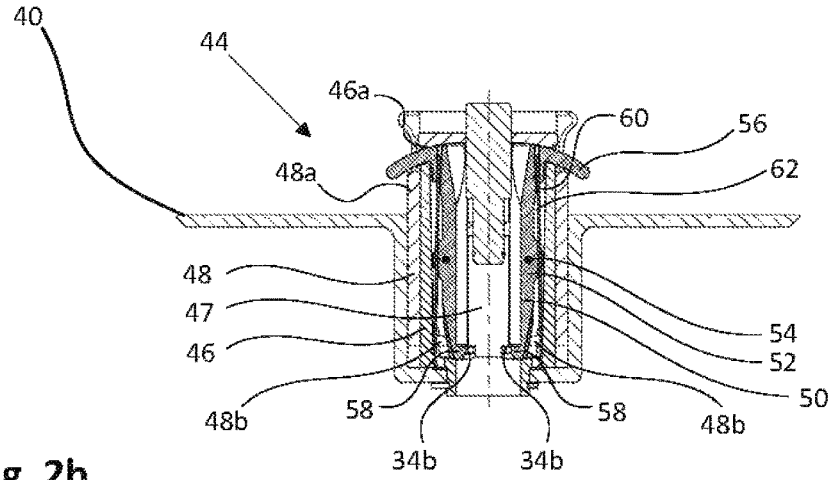
FIG. 2*b* is a lateral sectional view of the lid, in which locking has been activated and blocking activated.
Figure 2C:
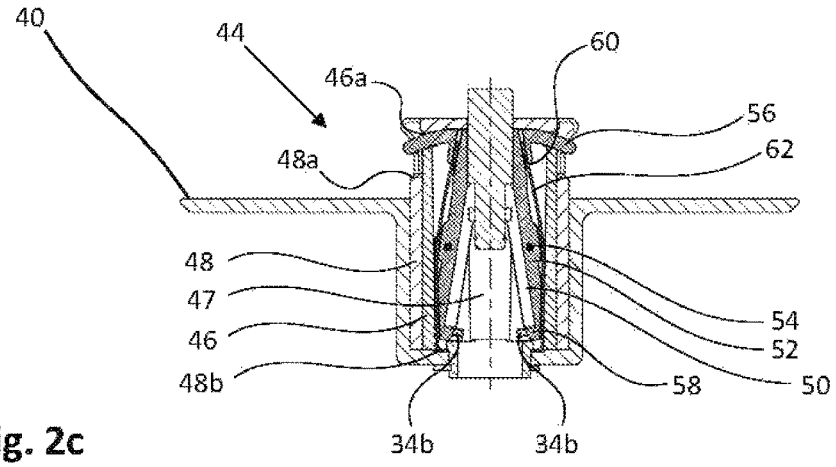
FIG. 2*c* is a lateral sectional view of the lid, in which both locking and blocking have been deactivated.

For the sake of clarity, the handle 44 is illustrated in detail in the views of FIGS. 2*a*, 2*b* and 2*c*. The handle 44 has a cylindrical bearing body 46 which has a wall 48 mounted for movement in an axial direction on its outer wall. Within said bearing body 46, two tilt levers 50 are mounted opposite each other relative to the rotor axis R. The longitudinal extension of the tilt levers 50 is essentially aligned axially. Provided approximately in the middle of the cross-section of the tilt levers 50 is a thickened portion 52 which points toward the bearing body 46 and which is rounded. A strut 54 each, which has been omitted from this view for reasons of clarity, extends through these thickened portions 52, over which the tilt levers 50 can be tilted. The strut 54, together with its associated recess in the thickened portion 52, thus forms a pivot joint for the tilt lever with respect to the bearing body 46 and the wall 48 which completely surrounds at least parts of the latter. On the upper end of the tilt lever 50, there is an actuating member 56 which faces in a direction away from the rotor axis R. Moreover, each tilt lever 50 tapers in cross-section toward the upper end. The tilt lever 50 also tapers in cross-section toward the lower end, on which a latching element 58 each pointing to the rotor axis R is mounted on the tilt lever 50.

The actuating members 56 each have an associated recess 46*a* in the bearing body 46 and a recess 48*a* in the wall 48 through which the actuating members 56 partially protrude laterally from the handle 44.

At the upper end of each tilt lever 50 is a recess 60 each which is engaged by an end of a spring 62, more specifically a leaf spring, which is arranged along the bearing body 46 of the handle 44. The ends of the springs 62 which are remote from the recesses 60 are clamped onto the bearing body 46 and radially preloaded toward the outside. The spring 62 will thus urge the upper ends of the tilt levers 50 radially outwards, if, as shown in FIG. 2*a*, no force is applied manually from the outside, causing said to abut on the bearing body 46, and the actuating members 56 will protrude laterally from the handle 44 to a maximal extent. At the same time, the tilt levers 50 will be tilted about the struts 54 in such a way that the lower ends will be spaced from the bearing body 46. The latching elements 58 will latch into engagement with a circumferential groove 34*b* made in the external contour 34*a* of the rotor pin 34. In this position of the tilt levers 50 as shown in FIG. 2*a*, the rotor 10 and the lid 40 are locked together.

FIG. 2*b* shows the handle 44 with the tilt levers 50 in a position identical to the one of FIG. 2*a*, i.e. the locked position. Here, the wall 48 of the handle 44 has been moved axially relative to the bearing body 46 in a removal direction E. This relative change in position of the wall 48 with respect to the bearing body 46 is brought about by an operator grasping the handle 44 and lifting it without releasing the locking of lid 40 to rotor 10, rather than applying force to the actuating members 56 so as to tilt the tilt levers and release the latching elements 58 from the nut 34*b* made in the external contour 34*a* of the rotor pin 34.

The relative change in position of the wall 48 also displaces a projection 48*b* which is located on the end of the wall 48 that points in the direction of the receiving space 18, and extends in the direction of the rotor axis R and which penetrates a recess (not shown) in the bearing body 46. Lifting the wall 48 in the removal direction E will cause the projection 48*b* to abut on the tilt lever 50 in the area between the thickened portion 52 and the latching element 58. This will block the tilt lever 50 so as to keep it from being tilted about the strut, and the latching element 58 will thus be secured within the groove 34*b*. The locking effected between the rotor 10 and the lid 40 cannot be released in this blocked position.

A force which acts in a direction opposite to that of the removal direction E is applied to the wall 48 by a spring which is not shown for the sake of clarity. As soon as the operator turns off the rotor 10 or places it inside a centrifuge 100 and thus neutralizes the weight force acting on the handle 44, the wall 48 will return to its initial position and the blocking of the tilt levers 50 by each projection 48*b* will be released. The projection 48*b* of wall 48 thus constitutes a safety element which either blocks or allows actuation of the tilt lever 50, as required, depending on its respective position.

Figure 3:
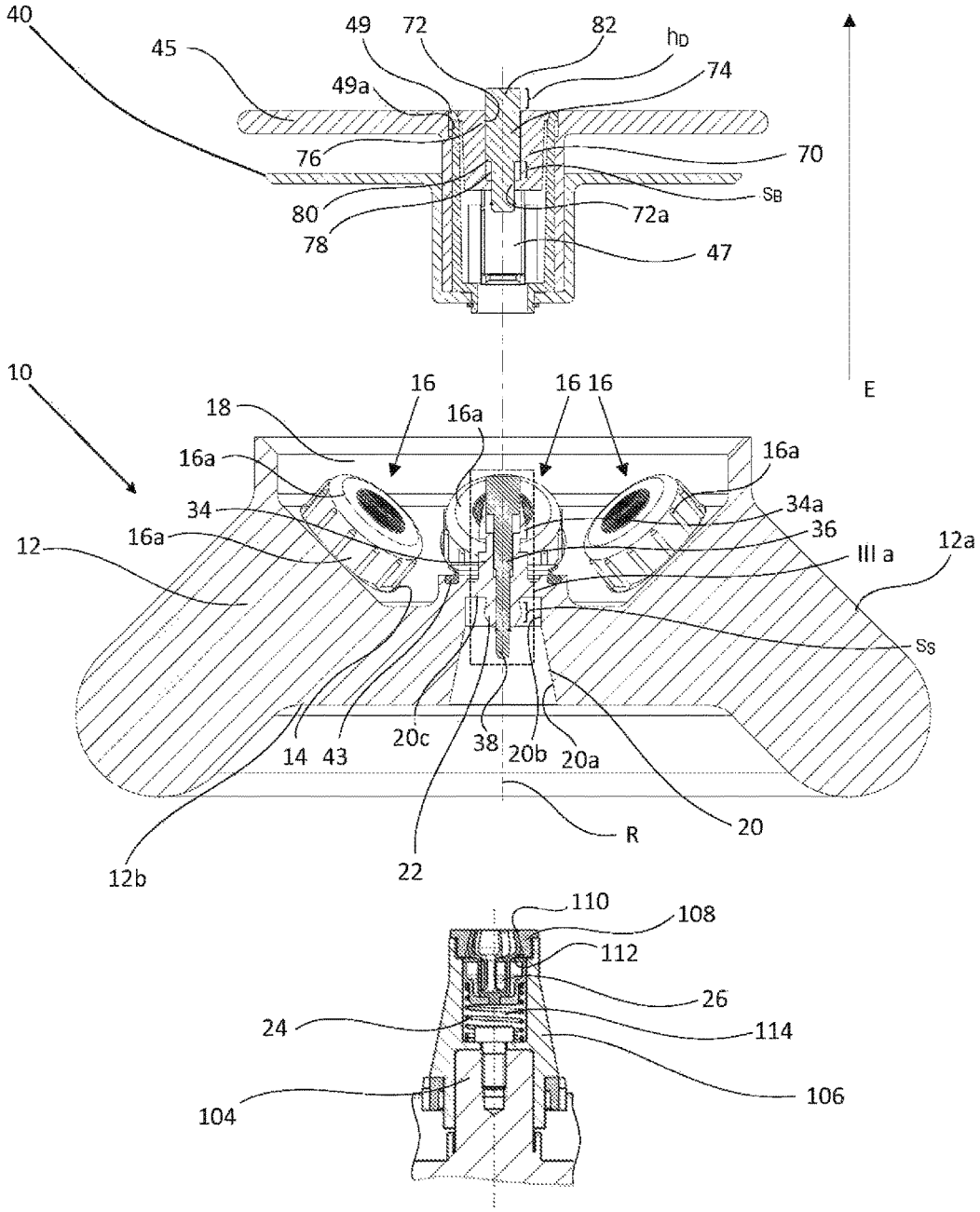
FIG. 3 is an exploded lateral sectional view of the rotor of FIG. 1 with the lid removed, as well as of the rotor receiving space of the drive shaft of a centrifuge (section through rotor shaft)
Figure 3A:
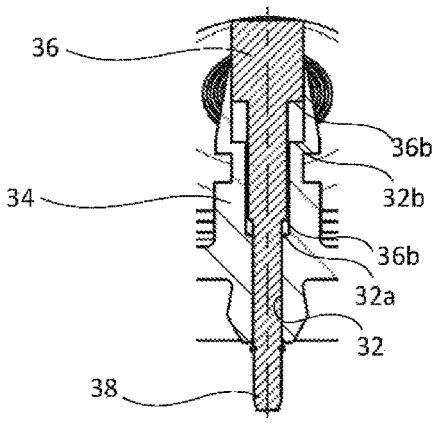
FIG. 3*a* is a view of a detail marked III a in FIG. 3.

As can be seen in FIG. 3, a bent free end 49 of the bearing body 46 and a shoulder 49*a* associated with the free end 49 and formed in the wall 48 together form a stop, thus limiting the axial displacement of the wall 48 on the bearing body 46.

In FIG. 2*c*, the wall 48 of the handle 44 is illustrated in its initial position again. The projection 48*b* is again below the tilt levers 50, which thus eliminates the blocking of the tilt levers 50 as shown in FIG. 2*b*. The tilt levers 50 are tilted about their pivot joints formed by a strut 54 and respective associated recess in the thickened portion 52, and the latching elements 58 are outside the groove 34*b*. The locking between the rotor 10 and the lid 40 has been released, and the lid 40 can be removed from the rotor 10.

The essentially axial design and arrangement of the tilt levers 50 allows for numerous possible designs of the locking of the lid 40 to the rotor 10. The rotor pin 34 could be made much more compact, for example, and the recess 42 of the lid 40 could be made longer so that—with the lid removed—more space is available in the receiving chamber 18 for sample containers 16 which then can simply be removed from the rotor or placed inside the rotor. Furthermore, the length of the tilt levers 50 and the length ratio of a leg associated with the actuating member 56 and a leg associated with the latching element 58 can be varied relative to each other and thus adapted to the respective conditions. In any case, the lid 40 will be firmly locked onto the rotor 10 by a latching element 58 mounted in the lid which engages a recess 34*b* made in the rotor 10, and the locking can be released via actuating members 56 arranged above the lid 40 at a position which can be reached conveniently by the operator.

Figure 5:
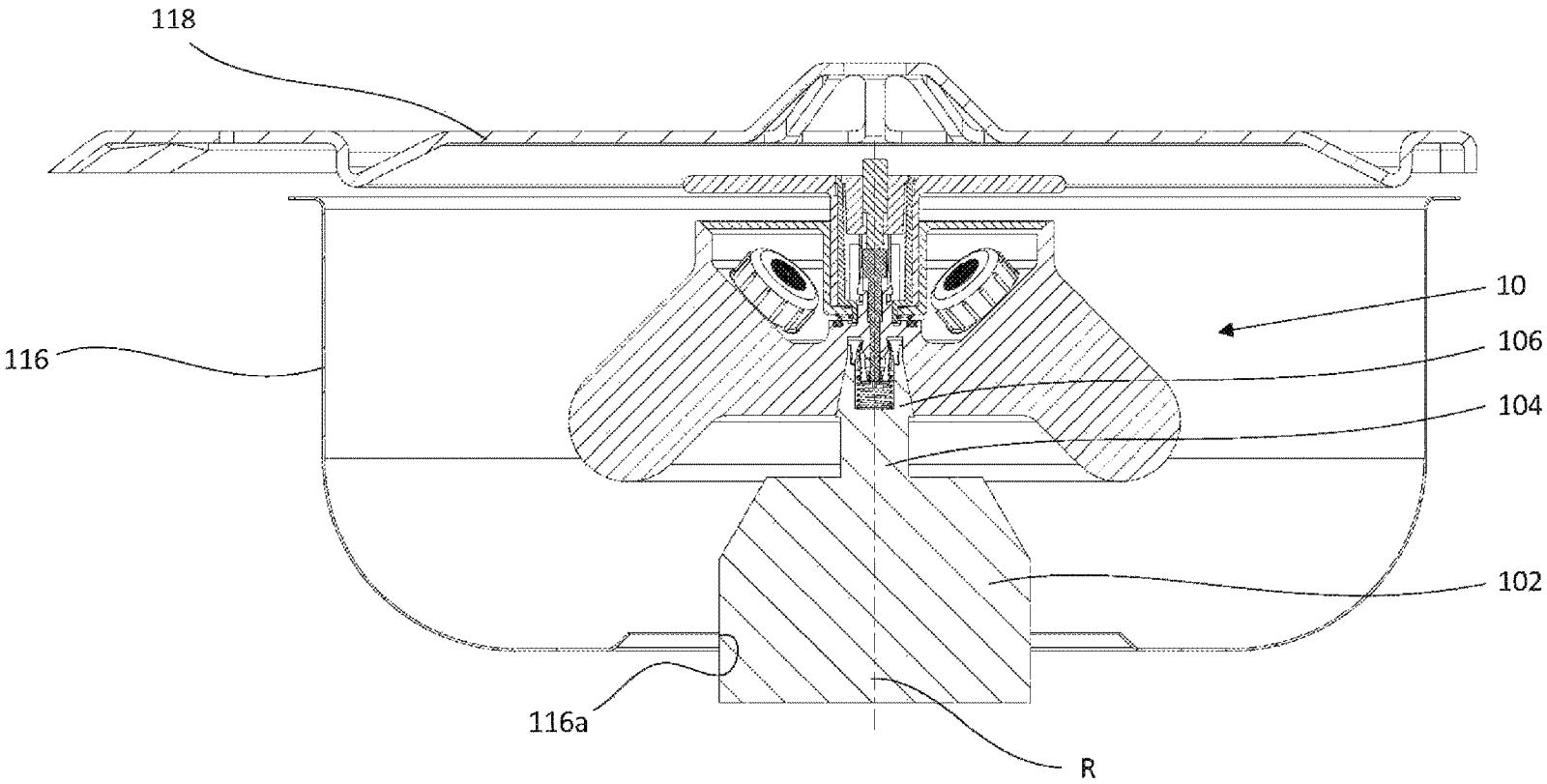
FIG. 5 is a lateral sectional view of a centrifuge of the invention.

FIG. 3 is an exploded lateral sectional view of the rotor 10—rotated by 90° relative to the views of FIGS. 2*a* to 2*c*—in an exploded view with the lid 40 removed, as well as of a support 106 of a centrifuge 100 which is also shown schematically in FIG. 5.

When the rotor 10 is placed onto the support 106 of the centrifuge 100, the locking ball 22 will engage an aperture 110 of an abutment insert 108 which is concentrically arranged on the support 106 and screwed together with the latter. The aperture 110 is dimensioned so as to allow passage of the locking ball 22 with minimum clearance. Following after the aperture 110 is an internal contour 112 of the abutment insert 108 which widens conically in a direction opposite to the direction of removal E.

Figure 3B:
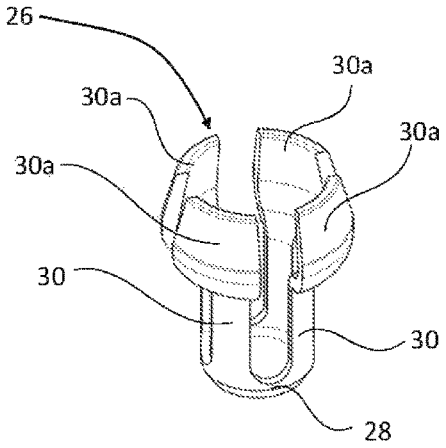
FIG. 3*b* is a perspective view of a blocking element.

Arranged in a cylindrical inner area 114 of the support 106 is a spring 24 in which a blocking unit 26 is mounted to which a spring force is applied which acts in the removal direction E, which blocking unit 26 is separately shown in FIG. 3*b* for reasons of clarity. The blocking unit 26 has four blocking springs 30 which are interconnected via a connecting ring 28 and each have a blocking element 30*a* mounted on their respective ends. The shape of the blocking elements 30*a* is essentially adapted to the external contour of the locking ball 22. Placing the rotor 10 onto the support 106 of the centrifuge 100 will cause the blocking elements 30*a* and thus the entire blocking unit 26 to be initially pressed downward, by the locking ball 22 entering the aperture 110, into the area of the internal contour 112 in the abutment insert 108 which is larger than the aperture 110 so that the blocking elements 30*a* can then be pressed apart. The blocking elements 30*a* then slide along the locking ball 22 to the point where they will ultimately surround the locking ball 22 with the rotor 10 completely in place on the support 106. The spring force will cause the blocking unit 30 to again move in the removal direction E, and the blocking elements 30*a* will abut on the internal contour 112 of the abutment insert 108. With the blocking elements 30*a* in abutment, the circumference of the locking ball 22 with the blocking elements 30*a* will increase to such an extent that it will no longer be able to pass through the aperture 110 of the abutment insert 108. The abutment of the blocking elements 30*a* on the internal contour 112 of the abutment insert 108 will thus prevent any movement of the blocking elements 30*a* in a radial direction. The rotor 10 is thus securely fixed in an axial direction on the support 106 of the centrifuge 100.

The locking ball 22 is penetrated by a bore 32. The bore 32 extends from the locking ball 22 through the rotor head 12 and the adjacent rotor pin 34. As viewed in the removal direction E, the inner diameter of the bore 32 widens at a first shoulder 32*a* and again at a second shoulder 32*b*.

Reaching through the bore 32 is an unlocking pin 36 which in turn has a first shoulder 36*a* which is associated with the first shoulder 32*a* of the bore 32, and a second shoulder 36*b* which is associated with the second shoulder 32*b* of the bore 32. For reasons of clarity, the area marked III a in FIG. 3 which shows the unlocking pin 36 inserted in the bore 32 is illustrated in detail in FIG. 3*a*. In the areas respectively associated with each other, the diameter of the unlocking pin 36 and the internal diameter of the bore 32 are adapted to each other so as to allow axial movement of the unlocking pin 36 within the bore 32. Axial movement of the unlocking pin 36 in the direction of the support 106 is limited and possible up to a final position in which the respective corresponding shoulders 32*a* and 36*a* as well as the shoulders 32*b* and 36*b* will then abut on each other.

The longitudinal extension of the unlocking pin 36 is dimensioned such that a free end 38 thereof will be made to protrude from the locking ball 22 as the unlocking pin 36 is moved against the removal direction E, will engage the blocking unit 26 and increasingly displace the blocking unit 26 against the force of the spring 24, with the blocking elements 30*a* also moving along the locking ball 22 into the area of the internal contour 112 which is wider than the aperture 110 of the abutment insert 108, thus allowing the blocking elements 30*a* to bend outwardly. Once unlocking pin 36 reaches the above described final position, the blocking unit 26 has been moved by a distance $s_S$ to such an extent that the blocking elements 30*a* will completely release the locking ball 22, i.e. as the locking ball 22 passes the blocking elements 30*a*, the latter will be bent radially outwardly. The locking ball 22 will then be able to pass through the aperture 110 of the abutment insert 108 again, and the rotor 10 can be taken off the support 106 of the centrifuge 100.

It is also conceivable to interchange the positions of the locking ball 22 and of the blocking unit 30, i.e. to have the locking ball 22 arranged on the side of the shaft, to mount the blocking unit 30 for axial movement in the rotor 10, with the internal contour 112 of the abutment insert 110 consequently tapering in the removal direction E.

For activating the unlocking pin 36, an actuating pin 74 is provided in the handle 44, which—together with the unlocking pin 36—forms an activating element 36,74.

For this purpose, a support insert 70 is incorporated in the bearing body 46 of the handle 44, concentrically to the rotor axis R, which is flush with the handle pieces 45 on the side facing away from the rotor 10. An axial bore 72 runs through the support insert 70 and tapers in steps at the end facing the rotor 10 so as to form an aperture 72*a* there which is smaller in diameter than the diameter of the bore 72.

The actuating pin 74 is movably mounted within the bore 72 and comprises a cylindrical first portion 76 which is adapted in diameter to the internal diameter of the bore 72, as well as a cylindrical second portion 78 which is adapted in diameter to the internal diameter of the aperture 72*a*. The second portion 78 runs through the aperture 72*a* and engages an inner space 47 of the handle 44 which is delimited laterally by the bearing body 46. A shoulder 80 formed between the first portion 76 and the second portion 78 thus serves as a boundary for axially moving the actuating pin 74 into a final position, against the removal direction E. The free end of the first portion 76 is designed as a pushbutton 82 which, in its non-depressed state, projects completely from the support insert 70 and is of a height $h_D$. When the pushbutton 82 is completely depressed, it will be flush with the free side of the support insert 70, and the actuating pin 74 will be moved against the removal direction E by a distance $s_B$ which corresponds to the height $h_D$. The actuating pin 74 is thus moved into its above described final position.

As the lid 40 is placed onto the rotor 10, the rotor pin 34 housing the unlocking pin 36 will enter the inner space 47 of the bearing body 47 of the handle 44 through the aperture 42*a*. Centering the lid 40 will be facilitated by the conically tapering external contour 34*a* on the free end of the rotor pin 34.

The lengths of the unlocking pin 36 and the actuating pin 74 have been chosen such that their ends which face each other will abut on each other once the lid 40 is completely in place on the rotor 10. Thus the unlocking pin 36 and the actuating pin 74 together form an activating element 36, 74 which can be used to move the blocking unit 26 axially by the distance $s_S$ into a release position even with the lid 40 in place, and the lock between the rotor 10 and the shaft 104 can be deactivated in the manner described above, thus allowing the rotor 10 to be taken off the support 106.

In the present embodiment, the height $h_D$ of the pushbutton 82 is of the same length as the distance $s_B$ and the distance $s_S$. The pushbutton 82 may also be designed to be higher, in which case it will also protrude from the support insert 70 in its activated state. However, the height $h_D$ must not be smaller or not much smaller than the length of the distances $s_B$ and $s_S$, else the required height of stroke of the blocking unit 26 for unlocking will not be obtained and unlocking cannot be reliably ensured anymore.

Similarly, it is possible to form the activating element 36, 74 as one piece and optionally either mount it in the handle 44 of the lid 40 or in the receiving chamber 18 of the rotor 10, in the rotor pin 34. When the activating element 36, 74 is mounted in the handle 44, the rotor pin 34 can be of a more space-saving design, or the rotor pin 34 can almost completely be omitted.

Figure 4:
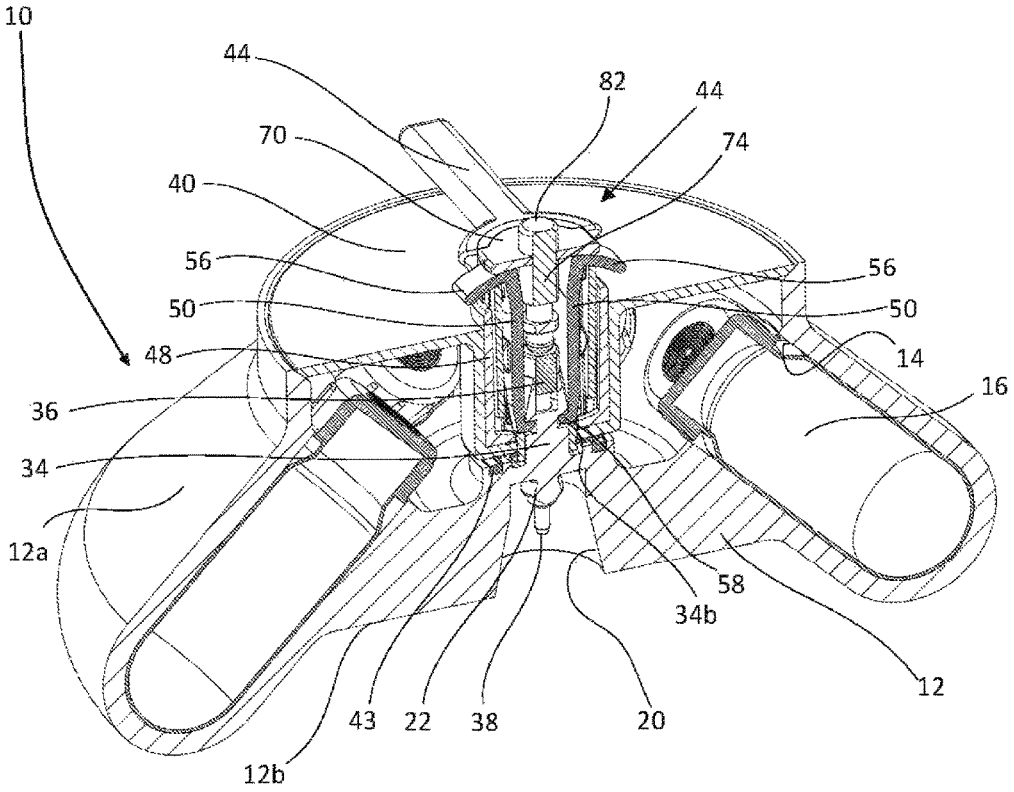
FIG. 4 is a perspective sectional view of the rotor, similar to the view of FIG. 1.

The perspective view of FIG. 4 illustrates how the locking mechanism 50, 34*b* for interlocking the lid 40 and the rotor, and the blocking device 22, 24, 26 for securing the rotor 10 to the drive shaft 104 are embedded in the handle 44. The operator will thus only need one hand to operate the two unlocking means, and will not have to change the position of his hand much, either. Since the pushbutton 82 will have to be pressed down vertically to unlock the blocking device 22, 24, 26 which secures the rotor 10 to the shaft 104, whereas unlocking the device which secures the lid 40 to the rotor 10 is accomplished by exerting horizontal pressure on both sides of the two actuating members 56, the risk of incorrect use is low.

FIG. 5 is a lateral sectional view of a centrifuge 100 according to the invention, from which a housing and a base have been omitted for reasons of clarity.

As already described with reference to FIG. 3, the rotor 10 illustrated in FIGS. 1 to 4 is connected to the drive shaft 104 via the support 106 and rotates about rotor axis R. The drive shaft 104 is driven by the motor 102 underneath it.

For safety and soundproofing reasons, the rotor 10 is surrounded by a safety vessel 116. The motor 102 engages the safety vessel 116 via an aperture 116*a*.

Provided above the safety vessel 116 is a centrifuge lid 118 which is connected to the housing (not shown) in a conventional manner and seals the centrifuge 100 at its top.

LIST OF REFERENCE SIGNS

10 rotor
12 rotor head
12*a* lateral surface
12*b* bottom
14 receiving units
16 sample containers
16*a* sealing caps
18 receiving chamber
20 rotor seat
20*a* first portion
20*b* second portion
20*c* boundary surface
22 locking ball
24 spring
26 blocking unit
28 connecting ring
30 blocking springs
30*a* blocking elements
32 bore
32*a* first shoulder

32*b* second shoulder
34 rotor pin
34*a* external contour
34*b* groove
35 shoulder
35*a* front face
36 unlocking pin
36*a* first shoulder
36*b* second shoulder
38 free end
42*b* front face
43 seal
44 handle
45 handle pieces
46 bearing body
46*a* recess
47 inner space
48 wall
48*a* recess
48*b* projection
49 free end
49*a* shoulder
50 tilt lever
52 thickened portion
54 strut
56 actuating member
58 latching element
60 recess
62 springs
70 support insert
72 bore
72*a* aperture
74 actuating pin
76 first portion
78 second portion
80 shoulder
82 pushbutton
100 centrifuge
102 motor
104 shaft
106 support
108 abutment insert
110 aperture
112 internal contour
114 inner area
E removal direction
R rotor axis
$h_D$ pushbutton height
$s_B$ activation distance of actuating pin
$s_S$ activation distance of blocking unit What claimed is:

1. A rotor (10) of a centrifuge (100), comprising:
a rotor axis (R);
a receiving chamber (18) in said rotor for a sample container to be centrifuged;
said receiving chamber includes a top;
a pin (34);
said pin (34) resides in said receiving chamber (18);
said pin (34) is coaxial with said rotor axis (R);
said pin includes recess (34*b*) for engaging a latching element (58);
a lid (40);
said lid (40) resides at said top of said receiving chamber (18);
said lid (40) is concentrically mounted relative to said rotor;
a handle (44) for carrying said rotor and said lid (40);
said handle (44) mounted remotely with respect to said receiving chamber (18);
a locking mechanism for locking said lid (40) to said rotor;
said lid includes an aperture (42*a*);
said pin (34) at least partly engages said handle (44) through said aperture (42*a*) in said lid (40);
a support (52, 54) in said lid (40);
said locking mechanism is mounted in said support (52, 54) in said lid (40), and said locking mechanism is adapted to be movable between a locking position when said lid is affixed to said rotor and an unlocking position when said lid is not affixed to said rotor;
said locking mechanism comprises:
a tilt lever (50), said tilt lever includes an upper end, a lower end, and a pivot axis aligned perpendicular to said rotor axis (R);
an actuating member (56) and said latching element (58);
said actuating member (56) resides on said upper end of said tilt lever (50) and a latching element (58) resides on said lower end of said tilt lever (50), said actuating member (56) and said latching element (58) being axially spaced from each other relative to said rotor axis (R), and, said tilt lever being rotatable about said pivot axis enabling locking of and unlocking of said lid and said rotor.

2. A rotor (10) of a centrifuge (100), comprising:
a rotor axis (R);
a receiving chamber (18) in said rotor for a sample container to be centrifuged;
said receiving chamber includes a top;
a pin (34);
said pin (34) has an end;
said pin (34) resides in said receiving chamber (18);
said pin (34) is coaxial with said rotor axis (R);
said pin (34) includes a coaxial shoulder (35);
said pin is partially conical and tapers toward said end;
said pin (34) includes a recess (34*b*) for engaging a latching element (58) of a tilt lever (50);
a seal (43) is mounted in said coaxial shoulder and surrounds said pin (34);
a lid (40);
said lid resides at said top of said receiving chamber (18);
said lid is concentrically mounted relative to said rotor;
said lid (40) includes an aperture (42*a*) therein;
a support (52, 54) in said lid (40);
a handle (44) for carrying said rotor and said lid (40);
said handle (44) is mounted remotely with respect to said receiving chamber (18);
a locking mechanism (50, 34*b*) for locking said lid (40) to said rotor;
said locking mechanism is mounted in said support (52, 54) in said lid (40);
said locking mechanism is adapted to be movable between a locking position when said lid is affixed to said rotor and an unlocking position when said lid is not affixed to said rotor;
said locking mechanism comprises:
said tilt lever (40) includes an upper end, a lower end, and a pivot axis aligned perpendicular to said rotor axis (R);
an actuating member (56) and said latching element (58);
said actuating member resides on said upper end of said tilt lever and said latching element resides on said lower end of said tilt lever, said actuating member (56) and said latching element (58) being axially spaced from each other relative to said rotor axis (R), and, said tilt lever being rotatable about said pivot axis enabling locking of and unlocking of said lid and said rotor;

said lid (40), when in said locking position, abuts and engages said seal (43);

said seal (43) is adapted to seal said receiving chamber (18) of said rotor from said pin (34); and, said seal (43) is adapted to seal receiving chamber (18) of said rotor from said aperture (42*a*) of said lid (40).

* * * * *